US006759938B2

(12) United States Patent
Matsumura et al.

(10) Patent No.: US 6,759,938 B2
(45) Date of Patent: Jul. 6, 2004

(54) FUSE LINK ASSEMBLY AND LAYOUT METHOD THEREFOR

(75) Inventors: Norio Matsumura, Shizuoka (JP); Haruhito Ohtsuka, Shizuoka (JP); Hiroaki Yamada, Shizuoka (JP); Tsuyoshi Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/131,079

(22) Filed: Apr. 25, 2002

(65) Prior Publication Data

US 2002/0167390 A1 Nov. 14, 2002

(30) Foreign Application Priority Data

Apr. 27, 2001 (JP) ..... P2001-133553

(51) Int. Cl.[7] ..... H01H 85/12; H01H 85/08

(52) U.S. Cl. ..... 337/161; 337/295; 337/255; 337/290

(58) Field of Search ..... 337/161, 162, 337/164, 189, 229, 255, 293, 295, 264, 290; 29/623

(56) References Cited

U.S. PATENT DOCUMENTS

| | | | | |
|---|---|---|---|---|
| 2,222,642 A | | 11/1940 | Xenis | |
| 2,934,627 A | * | 4/1960 | Bristol et al. | 337/293 |
| 4,842,534 A | * | 6/1989 | Mobley et al. | 439/214 |
| 5,088,940 A | * | 2/1992 | Saito | 439/621 |
| 5,438,310 A | * | 8/1995 | Ikari | 337/208 |
| 5,474,475 A | * | 12/1995 | Yamaguchi | 439/621 |
| 5,643,693 A | * | 7/1997 | Hill et al. | 429/121 |
| 5,795,193 A | * | 8/1998 | Yang | 439/621 |
| 5,977,859 A | * | 11/1999 | Kawamura et al. | 337/295 |
| 6,007,350 A | * | 12/1999 | Isshiki | 439/76.2 |
| 6,178,106 B1 | * | 1/2001 | Umemoto et al. | 363/146 |
| 6,294,978 B1 | * | 9/2001 | Endo et al. | 337/166 |
| 6,322,376 B1 | * | 11/2001 | Jetton | 439/76.2 |
| 6,558,198 B2 | * | 5/2003 | Kobayashi et al. | 144/134.1 |

FOREIGN PATENT DOCUMENTS

| | | | | |
|---|---|---|---|---|
| DE | 198 01 596 A1 | | 7/1999 | |
| DE | 198 08 237 A1 | | 8/1999 | |
| EP | 0 123 822 A2 | | 11/1984 | |
| EP | 0 508 059 A2 | | 10/1992 | |
| JP | 10199395 A | * | 7/1988 | H01H/85/56 |
| JP | 2000-133114 | | 5/2000 | |

OTHER PUBLICATIONS

Patent Abstracts of Japan vol. 2000, No. 08, Oct. 6, 2000 & JP 2000 133114 A (Yazaki Corp), May 12, 2000.

* cited by examiner

*Primary Examiner*—Anatoly Vortman
(74) *Attorney, Agent, or Firm*—Sughrue Mion, PLLC

(57) ABSTRACT

A fuse circuit (11) having a plurality of terminals (22, 23) provided on a common joint plate (21) and a fuse circuit (11') having a plurality of terminals (22', 23') provided on a common joint plate (21') are incorporated into a housing (12), thereby constituting a fuse link assembly (10). The plurality of fuse circuits (11, 11') are provided with circuit connection portions (27, 27') which share a power input portion. The fuse circuits (11, 11') are incorporated into the housing (12) in parallel. As a result, the number of circuits is increased, by means of only enlargement of widthwise direction Y which is easy to increase while enlargement of longitudinal direction X stemming from packaging of circuits is minimized.

28 Claims, 13 Drawing Sheets

FUSE LINK ASSEMBLY AND LAYOUT METHOD THEREFOR

BACKGROUND OF THE INVENTION

1. Field of the Invention

The present invention relates to a fuse link assembly designed so as to incorporate, into a housing, a plurality of terminals while being connected in a chain manner, as well as to a layout method for the fuse link assembly.

The present invention is based on Japanese Patent Application No. 2001-133553, the entire contents of which are incorporated herein by reference.

2. Related Art

In association with recent developments in electronic control, the number of electronic components used in a vehicle, such as an automobile, has increased. Such an increase in the number of electronic components has in turn led to demand for a large-current fuse. In this case, in order to enhance the efficiency of housing a fuse, there has been proposed a fuse link assembly 1 such as that described in Japanese Patent Application No. 133114/2000 and shown in FIG. 16.

In the fuse link assembly 1, a fuse circuit 5 is constituted by providing a plurality of first terminals 3 and a second terminal 4 on a straight joint plate 2. The fuse circuit 5 is incorporated into a housing 6. The housing 6 is closed with a cover 7 while housing the fuse circuit 5.

However, since a number of the electronic components to be used in a vehicle tend to be increased recently, such the fuse link assembly is required to pack a larger number of circuits. In the fuse link assembly 1 shown in FIG. 16, the first terminals 3 and the second terminal 4 are arranged in a straight line along the joint plate 2. When an attempt is made to increase the number of circuits, the first terminals 3 and the second terminal 4 are increased in number by extending merely the joint plate 2.

When the number of circuits is increased by extending the joint plate 2, the fuse link assembly 1 is gradually extended in a longitudinal direction thereof. The number of circuits to be packed is significantly limited for such the fuse link assemblies due to the layout on the vehicle or restrictions on the geometry and mountability of a relay box.

SUMMARY OF THE INVENTION

The present invention has been conceived to solve the problem of the related art and aims at providing a fuse link assembly which enables packing of an increased number of circuits while miniaturizing the overall fuse link assembly and saving space when a fuse circuit having a plurality of terminals provided in a chain manner is incorporated into a housing, as well as providing a layout method for the fuse link assembly.

To achieve the object, there is provided a fuse link assembly comprising: at least two fuse circuits, each having a plurality of terminals, a common joint plate and a circuit connection portion, the terminals being be arranged longitudinally in a chain manner and connected to the joint plate with fusible portions; and a housing in which the fuse circuits are mounted; wherein the fuse circuits are mounted in the housing in parallel with each other and share a power input portion.

In the invention, the fuse circuits, each having a plurality of terminals provided thereon in a chain manner, are mounted in parallel in a housing. As a result, the number of circuits can be increased, by means of enlargement of the width of the housing in which the fuse circuits are provided in parallel, without involvement of an increase in the length of the housing in which terminals are to be connected. The fuse circuits arranged in parallel are connected to a power input portion by means of connecting a common circuit connection portion. Since separate joint plates can share the circuit connection section, the connection of I/O sections can be set efficiently.

More specifically, the plurality of terminals may be cut depending on the presence or absence of a circuit to be connected to the terminals.

By the above construction, the number of terminals to be provided in a chain manner can be changed arbitrarily in accordance with the number of circuits to which the fuse link assembly is to be attached. Hence, one type of fuse link assembly can be used for different circuits.

Further, the housing in which the fuse circuits are mounted may be connected directly to a relay box main body.

By the above construction, there can be omitted a block member which would otherwise be interposed between a housing having a plurality of use circuits incorporated therein and a relay box main body.

The invention provides a layout method for a fuse link assembly comprising the steps of: providing at least two fuse circuits, each having a plurality of terminals and a common joint plate, the terminals being be arranged longitudinally in a chain manner and connected to the joint plate with fusible portions; providing with a circuit connection portion sharing a power input portion; fastening the circuit connection portion together; and mounting the fuse circuits in the housing in parallel with each other.

According to the invention, a plurality of fuse circuits, each having a plurality of terminals provided in a chain manner, are incorporated into a housing in parallel while shared circuit connection portions are fastened. As a result, there can be effected fastening of a plurality of fuse circuits simultaneous with incorporation of the fuse circuits into a housing. Thus, ease of assembly operation can be simplified. Further, the number of fuse circuits can be increased in the widthwise direction in which the fuse circuits are juxtaposed, without involvement of an increase in the longitudinal direction in which terminals are linked.

BRIEF DESCRIPTION OF THE DRAWINGS

FIGS. 8A and 8B are explanatory views, wherein FIG. 8A is a front view of a first fuse circuit, and FIG. 8B is a side view of the same;

FIGS. 9A and 9B are explanatory views, wherein FIG. 9A is a front view of a second fuse circuit, and FIG. 9B is a side view of the same;

FIGS. 10A through 10B are explanatory views, wherein FIG. 10A is a front view of the housing, FIG. 10B is a bottom view of the same.

FIGS. 11A through 11D are explanatory views of the housing in which the first and second fuse circuits are incorporated, wherein FIG. 11A is a plan view of the housing, FIG. 11B is a front view of the same, FIG. 11C is a bottom view of the same, and FIG. 11D is a side view of the same;

FIGS. 12A through 12B are explanatory views of the fuse link assembly when mounted, wherein FIG. 12A is a plan view of the fuse link assembly, FIG. 12B is a front view of the same.

DETAILED DESCRIPTION OF THE PREFERRED EMBODIMENTS

Figure 1:
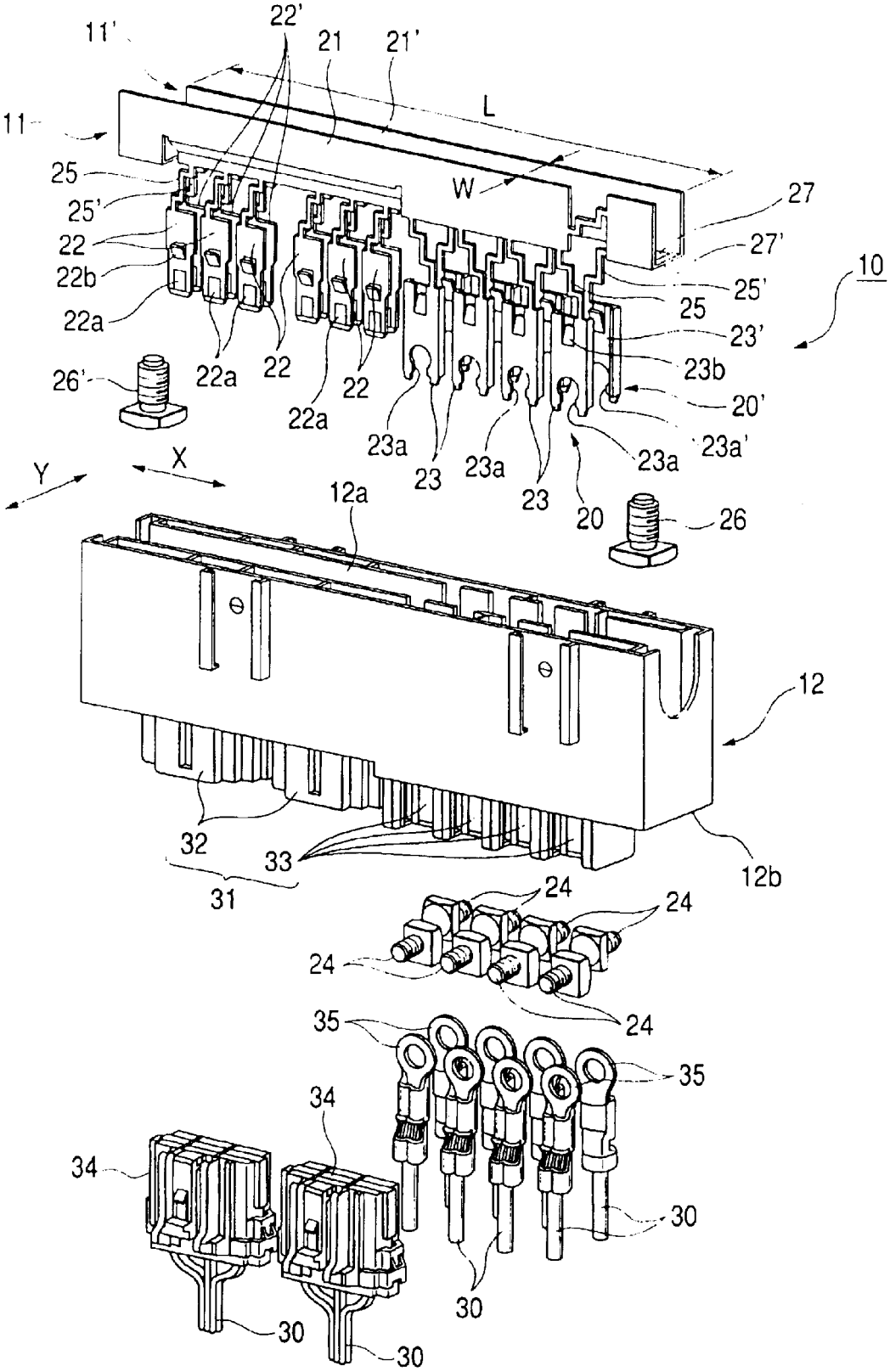
FIG. 1 is an exploded perspective view showing an embodiment of a fuse link assembly according to the invention.
Figure 2:
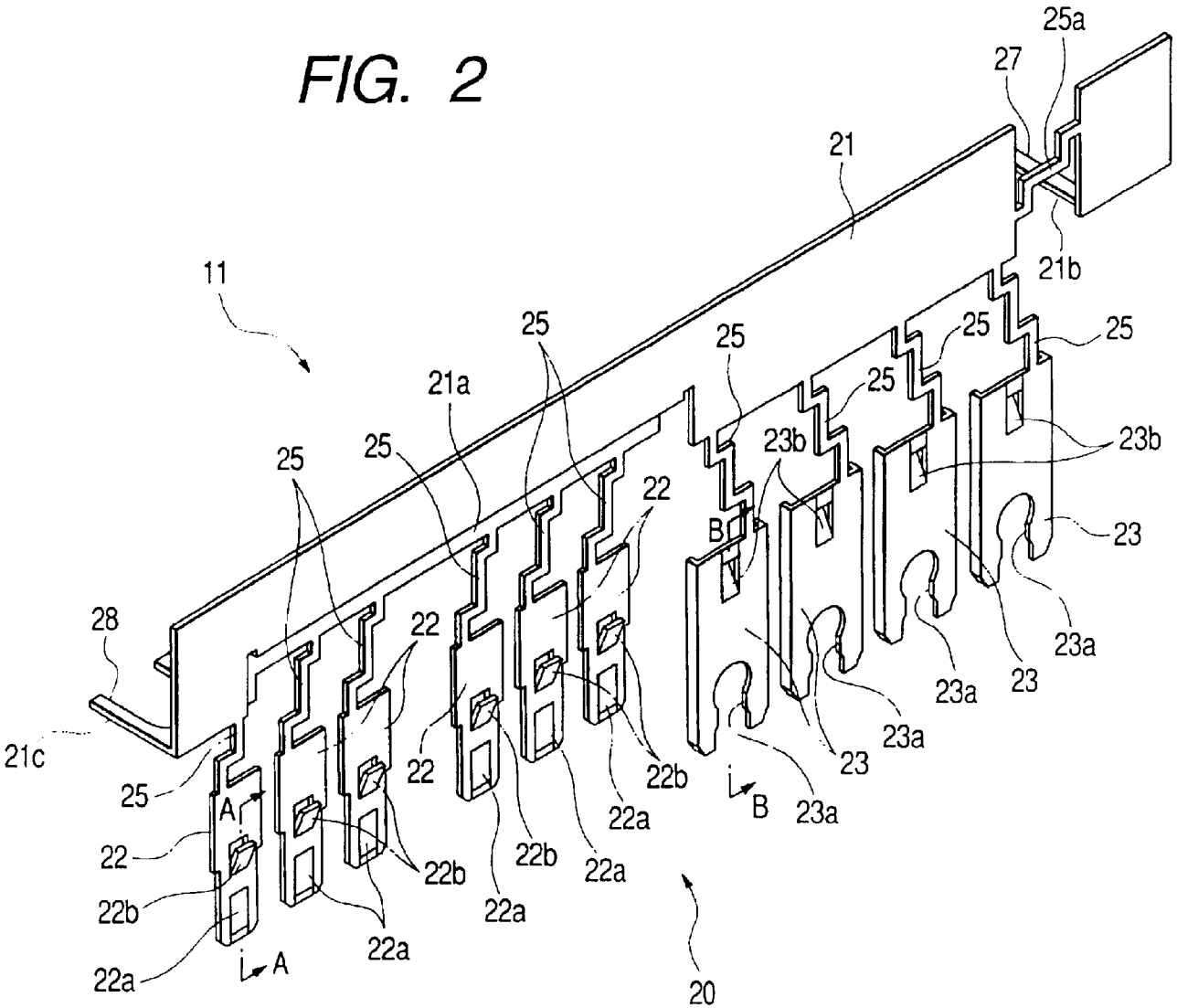
FIG. 2 is a perspective view of a first fuse circuit showing an embodiment of the fuse link assembly according to the invention.
Figure 3:
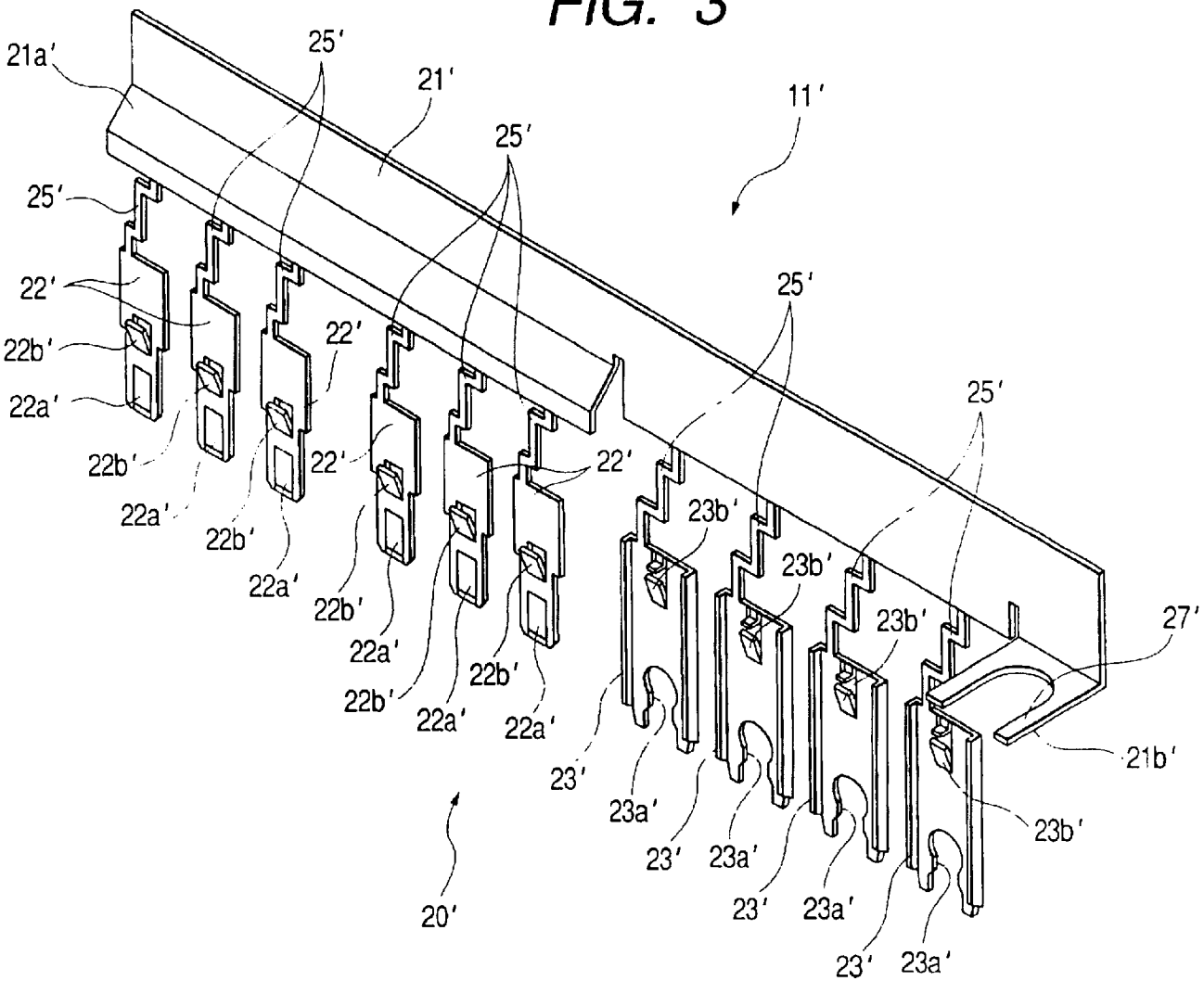
FIG. 3 is a perspective view of a second fuse circuit showing an embodiment of the fuse link assembly according to the invention.
Figure 4:
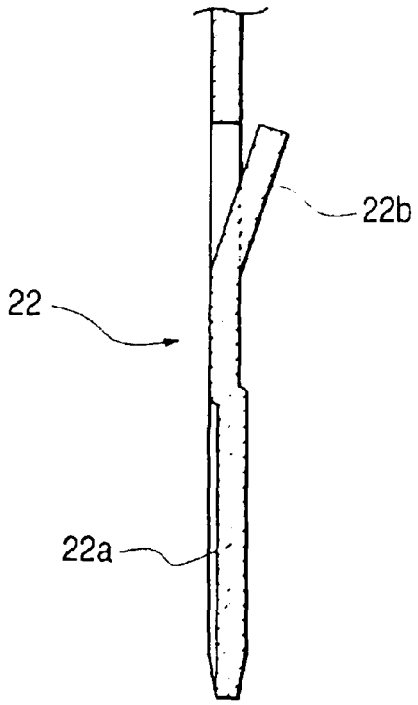
FIG. 4 is a cross-sectional view of an enlarged principal portion which shows an embodiment of the fuse link assembly according to the invention and is taken along line A-A shown in FIG. 2.
Figure 5:
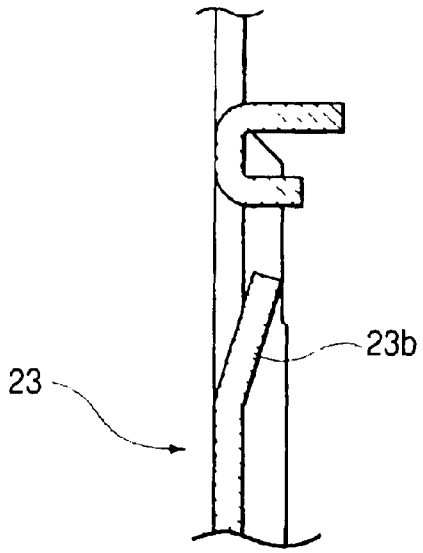
FIG. 5 is a cross-sectional view of an enlarged principal portion which shows an embodiment of the fuse link assembly according to the invention and is taken along line B-B shown in FIG. 2.
Figure 6:
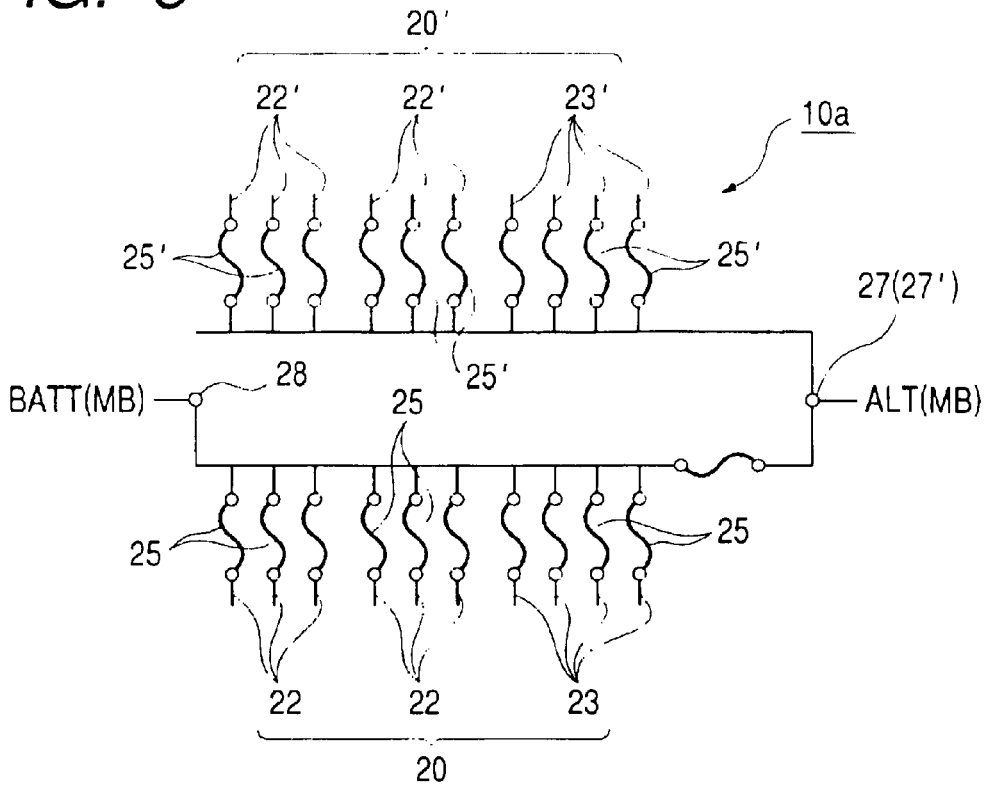
FIG. 6 is a circuit diagram showing an embodiment of the fuse link assembly according to the invention.
Figure 7:
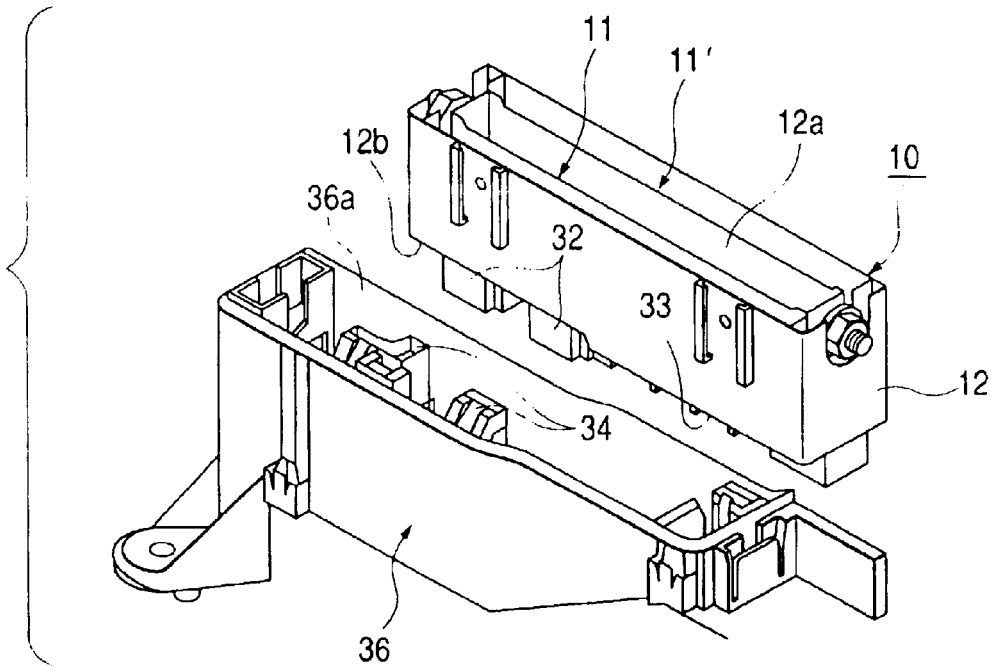
FIG. 7 is an explanatory view for mounting, showing an embodiment of the fuse link assembly according to the invention.

FIGS. 1 through 7 show an embodiment of a fuse link assembly according to the invention and that of a layout method therefor. FIG. 1 is an exploded perspective view of a fuse link assembly; FIG. 2 is a perspective view of a first fuse circuit; FIG. 3 is a perspective view of a second fuse circuit; FIG. 4 is an enlarged cross-sectional view of the principal portion taken along line A—A shown in FIG. 2; FIG. 5 is an enlarged cross-sectional view of the principal portion taken along line B—B shown in FIG. 2; FIG. 6 is a circuit diagram of a fuse link assembly; and FIG. 7 is an explanatory view for mounting the link fuse assembly.

As shown in FIG. 1, a fuse link assembly 10 according to the embodiment comprises a first fuse circuit 11, a second fuse circuit 11'; and a housing 12 for incorporating the fuse circuits 11, 11'. The first fuse circuit 11 is provided with a plurality of first terminals 20, and the second fuse circuit 11' is provided with a plurality of second terminals 20'. The first terminals 20 are provided on a common joint plate 21 which acts as a bus bar, in a chain manner. The second terminals 20' are provided on a common joint plate 21' which acts as a bus bar, in a chain manner.

As shown in FIG. 2, the first fuse circuit 11 is formed by punching the joint plate 21 from a metal plate material, punching the first terminals 20 in required positions on the joint plate 21, and bending the joint plate 21, as required. Each of the first terminal portions 20 comprises a total of six male terminals 22 connected in a chain manner, and a total of four screw terminals 23.

Each of the male terminals 22 assumes a rectangular shape tapered toward an extremity thereof. As shown in FIG. 4, a slit-like thin portion 22*a* is formed in the center on one surface of the extremity. Further, a bump piece 22*b* for preventing removal is formed in the center of an intermediate portion. Screw terminals 23 are formed into a rectangular shape, and a notch 23*a* to be used for mounting a stud 24 shown in FIG. 1 is formed in the center of the extremity. As shown in FIG. 5, a bump piece 23*b* is formed in the center of the upper end portion. Male terminals 22 and the screw terminals 23 are continuous with each other by way of fusible portions 25, 25 punched from the joint plate 21 so as to assume the shape of a crank and a narrow width.

A lower end of a boundary of an area in which the male terminals 22 are formed is cut from the joint plate 21, and the thus-cut area is formed into a folded portion 21*a* which is bent toward one side (i.e., the direction away from the viewer with reference to the direction orthogonal to a sheet of FIG. 2). The lower end is bent downward again. Accordingly, the male terminals 22 and the screw terminals 23 are spaced a predetermined interval apart from each other and extend in parallel.

One end of the joint plate 21 (i.e., a right-side end of the same) is extended further from the end of the area in which the screw terminals 23 are formed. A narrow-width folded portion 21*b* is formed in the extended portion so as to be folded in the same direction in which the folded portion 21*a* is folded. A notch 27 is formed in the folded portion 21*b* so as to act as a circuit connection portion in which a joint bolt 26 shown in FIG. 1 is inserted. The folded portion 21*b* is separated and spaced a predetermined interval apart from the joint plate 21. The folded portion 21*b* and the joint plate 21 are connected together via a narrow crank-shaped fusible portion 25*a*.

A folded portion 21*c* which is folded in the same direction in which the folded portion 21*a* is folded is formed at the other end of the joint plate 21 (i.e., the end of the joint plate 21 located in a position close to the viewer shown in FIG. 2). Formed in the folded portion 21*c* is a notch 28 to be used for inserting a bolt 26' for connecting a battery circuit shown in FIG. 1.

A second fuse circuit 11' is substantially identical in construction with the first fuse circuit 11. Corresponding constituent portions are appended with a dash ('), and explanations of their structures are omitted.

As shown in FIG. 3, the second fuse 11' is formed so as to be symmetrical to the first fuse circuit 11. A second terminal 20' provided in the joint plate 21' is provided, in a chain manner, with male terminals 22' and screw terminals 23', which are identical in number with those provided on the first terminal portion 20. A notch 27' is formed in a folded portion 21*b'* formed at one end (i.e., the end of the plate 21 close to the viewer shown in FIG. 3) so as to correspond to the notch 27. The notch 27' acts as a circuit connection portion in which the bolt 26 is to be inserted. A structure corresponding to a notch 28 for battery connection is not provided in the second fuse circuit 11'. The folded portions 21*a'*, 21*b'* of the joint plate 21' are folded in the direction close to the viewer in FIG. 3 so as to become symmetrical with the folded portions 21*a*, 21*b* of the first fuse 11.

As shown in FIG. 2, the housing 12 assumes a substantially-rectangular-parallelepiped shape, wherein an opening 12*a* is formed in an upper surface of the housing 12 in the drawing. An internal longitudinal dimension X of the housing 12 is set so as to become slightly longer than the length L of each of the first and second fuse circuits 11, 11'. As shown in FIG. 1, a widthwise dimension Y of the housing 12 is set so as to become slightly larger than the total width W of the first and second fuse circuits 11, 11' connected together in parallel.

As shown in FIG. 1, formed in a bottom surface 12*b* of the housing 12 is a connection portion 31 to be used for connecting the first and second terminals 20, 20' of the first and second fuse circuits 11, 11' to a wire harness 30. The connection 31 is constituted of two connectors 32 housing the extremities of the male terminals 22, 22' and four-gang terminal threads 33 into which the extremities of the screw terminals 23, 23' are to be inserted.

Mating connectors 34 connected to the terminal of the wire harness 30 are inserted into and connected to the connectors 32. Stud terminals 35 connected to the terminal of another wire harness 30 are fastened to the terminal threads 33 by way of the studs 24.

Openings in the connectors 32 are set so that the male terminals 22, 22' juxtaposed can cope with a plurality of types of existing connectors having different specifications, by adjusting the layout of the joint plates 21, 21'. The four-gang terminal threads 33 are formed such that each thread is symmetrical with reference to a plane running between the front and back sides of the threads. Four pairs of inlet holes, each pair being formed in the front and back sides of each terminal thread 33, are arranged systematically in the longitudinal direction X of the housing 12.

Such a fuse link assembly 10 is built up by housing the first and second fuse circuits 11, 11' into the housing 12. First, the first and second fuse circuits 11, 11' are assembled such that the folded portions 21*a*, 21*b* of the first fuse circuit 11 are superimposed on the folded portions 21*a'*, 21*b'* of the second fuse circuit 11'. As a result, the notches 27, 27' coincide with each other, and the joint bolt 26 is inserted into the thus-matching notches 27, 27', and the first and second fuse circuits 11, 11' are inserted into the opening portion 12*a* of the housing 12.

The male terminals 22 and 22' are attached to the connectors 32, and the screw terminals 23 and 23' are inserted into corresponding terminal threads 33. At this time, the studs 24 are inserted into the terminal threads 33, and the studs 24 are inserted into the notches 23*a*, 23*a* of the thread terminals 23 and the notches 23*a'* of the thread terminals 23'. In this state, the fuse link assembly 10 has been assembled preliminarily, thereby constituting a circuit 10*a* shown in FIG. 6. An ALT circuit (e.g. alternator) is connected to the notches 27, 27', and a battery circuit is connected to the notch 28 for battery connection purpose.

As shown in FIG. 7, the fuse link assembly 10 is removably and directly connected to a relay box main body 36. The relay box main body 36 assumes the shape of a box, and a rectangular insert hole 36*a* is formed in an upper end of the main body 36. The mating connectors 34 to be connected to the connectors 32 of the fuse link assembly 10 are provided in the bottom of the relay box main body 36. The bottom of the relay box main body 36 corresponding to the terminal threads 33 of the fuse link assembly 10 is opened downward, and stud terminals 35 shown in FIG. 1 are fastened to the terminal threads 33 projecting from the opening.

In the fuse link assembly 10 according to the embodiment, the plurality of male terminals 22 and the thread terminals 23 constituting the first terminal portion 20 and the plurality of male terminals 22' and the thread terminals 23' constituting the second terminal 20' are cut as required in accordance with the availability of a circuit to be connected to these elements.

Specifically, the number of electronic components to be used changes in accordance with the type and grade of a vehicle. Accordingly, unnecessary terminals from among the male terminals 22 and 22' and the screw terminals 23 and 23' are cut and removed from the fusible portions 25, 25' in accordance with the type of a vehicle in which the terminals are to be mounted. Thus, the number of circuits can be diminished.

The fuse link assembly 10 according to the embodiment is disposed in a vehicle such as an automobile which serves as an object. The fuse link assembly 10 is connected to circuits of various types of electronic components mounted on a vehicle. In this case, the fuse link assembly 10 is provided in a space where the fuse link assembly can be mounted, such as an engine compartment.

In the fuse link assembly 10 according to the embodiment, two (first and second) fuse circuits 11, 11' are incorporated into one housing 12. Further, the first fuse circuit 11 is provided with the first terminals 20, and the second fuse circuit 11' is provided with the second terminals 20'. In connection with each of the first terminal portions 20, the plurality of male terminals 22 and the plurality of thread terminals 23 are provided in a chain manner on the joint plate 21. Further, in connection with each of the second terminal portions 20', the plurality of male terminals 22' and the plurality of thread terminals 23' are provided in a chain manner on the joint plate 21'. Hence, as a result of the first and second fuse circuits 11, 11' being incorporated into the housing 12, the fuse link assembly 10 can significantly increase the number of corresponding circuits.

Despite the ability to increase the number of circuits, the first and second fuse circuits 11, 11' are incorporated in parallel into the fuse link assembly 10. Hence, the housing 12 is not extended in the longitudinal direction X in which the first and second terminals 20, 20' are connected in a chain manner. The housing 12 enables an increase in the number of circuits to be disposed, by means of an increase in the widthwise direction Y in which the first and second fuse circuits 11, 11' are provided in parallel.

Accordingly, the fuse link assembly 10 enables an increase in the number of circuits, by means of only an increase in the fuse link assembly 10 in its widthwise direction Y in which the assembly is easy to increase while minimizing an increase in the length of the fuse link assembly 10 in its longitudinal direction X stemming from packing of circuits.

The first and second fuse circuits 11, 11' which are provided in parallel are connected to a common ALT circuit by connecting the notches 27, 27' to be superimposed on each other by means of the joint bolt 26. Hence, the ALT circuit can be shared between the separated joint plate 21, 21'. Hence, connection between input/output portions can be set efficiently.

At the time of the first, second fuse circuits 11, 11' being incorporated into the housing 12, the notches 27, 27' can be incorporated in parallel into the housing 12 by means of the bolts 26. Thus, the ease of assembly can be simplified.

In the fuse link assembly 10 according to the embodiment, circuits to be packed can be laid out in a compact and space saving manner even when there is an increase in the number of circuits. Further, an output portion can be set efficiently.

In the embodiment, a plurality of male terminals 22 and 22' and the plurality of screw terminals 23 and 23' constituting the first, second terminal portions 20, 20' are cut in accordance with presence or absence of a circuit to be connected to the first and second terminal portions 20, 20'. The fuse link assembly 10 is designed beforehand to comprise all the male terminals 22 and 22' and all the screw terminals 23 and 23' so as to cope with a vehicle which is assumed to be provided with the fuse link assembly 10 and has the largest number of circuits. When the fuse link assembly 10 is mounted on a vehicle involving a smaller number of required circuits, terminals which have become unnecessary in correspondence with circuits to be reduced are merely cut, thereby enabling the fuse link assembly to readily cope with the vehicle.

In the fuse link assembly 10, the number of male terminals 22 and 22' and screw terminals 23 and 23' to be provided in a chain manner can be changed arbitrarily in accordance with the number of circuits of a vehicle on which the fuse link assembly is to be provided. Hence, one type of fuse link assembly 10 can be used for different types of vehicles or grades of vehicles.

As shown in FIG. 7, in the embodiment, since the fuse link assembly 10 is inserted removably into and coupled directly to the relay box main body 36, the fuse link assembly 10 can be coupled directly to the relay box main body 36 while the first and second fuse circuits 11, 11' are incorporated into the housing 12. Hence, there can be omitted an unillustrated block body, which would otherwise be interposed between the housing 12 and the relay box main body 36 in normal times. Hence, an operation for mounting the fuse link assembly 10 is simplified, and there can be achieved cost cutting in association with omission of a block body.

Figure 8B:
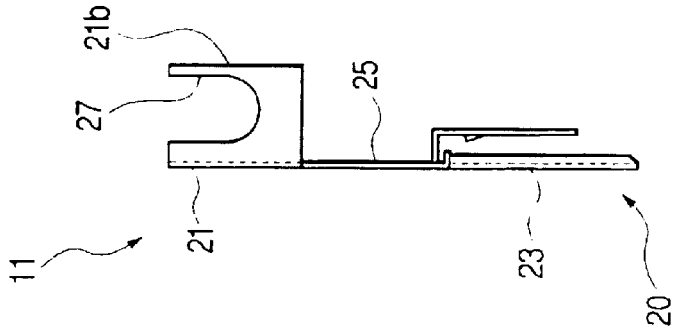
Figure 8A:
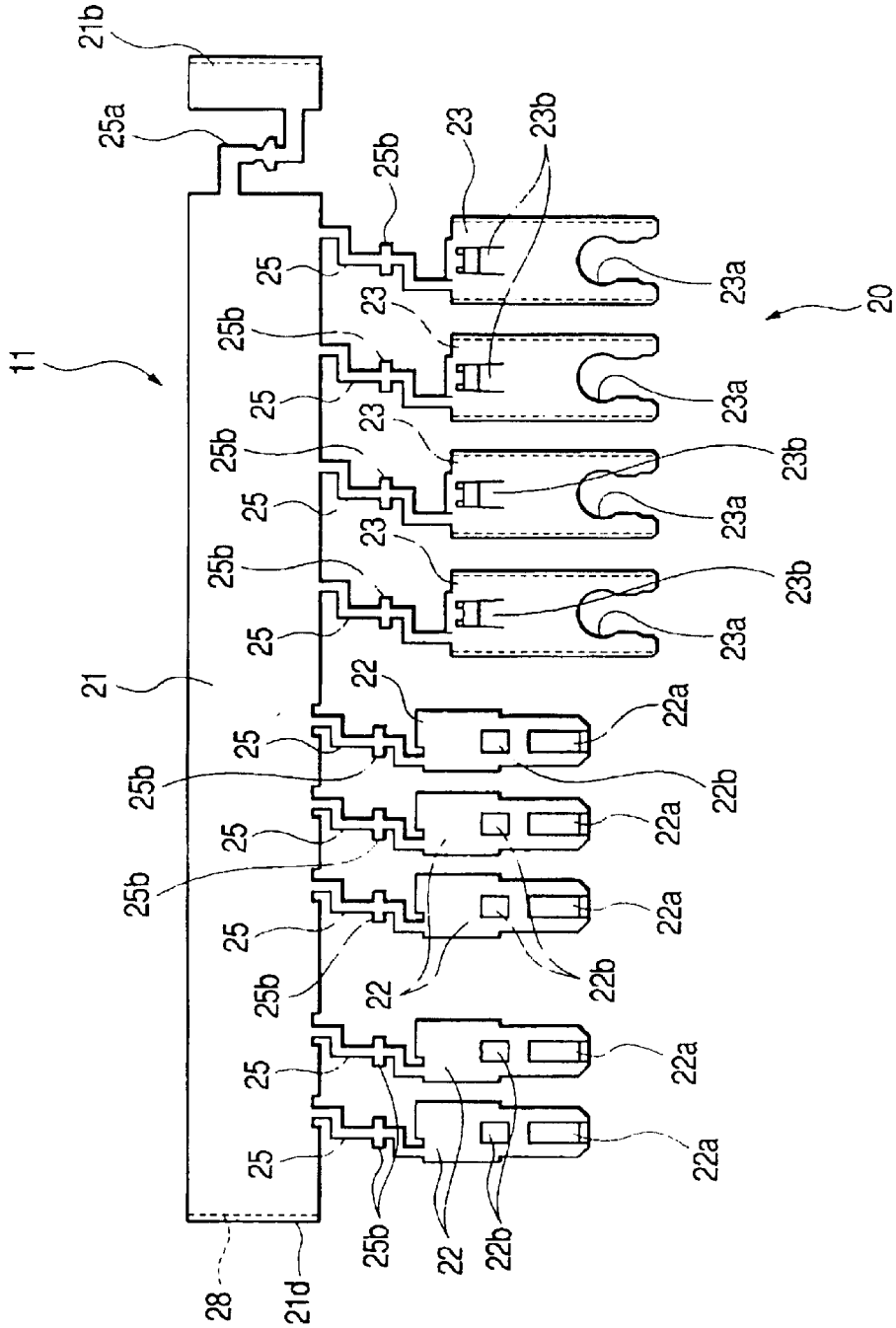
Figure 13:
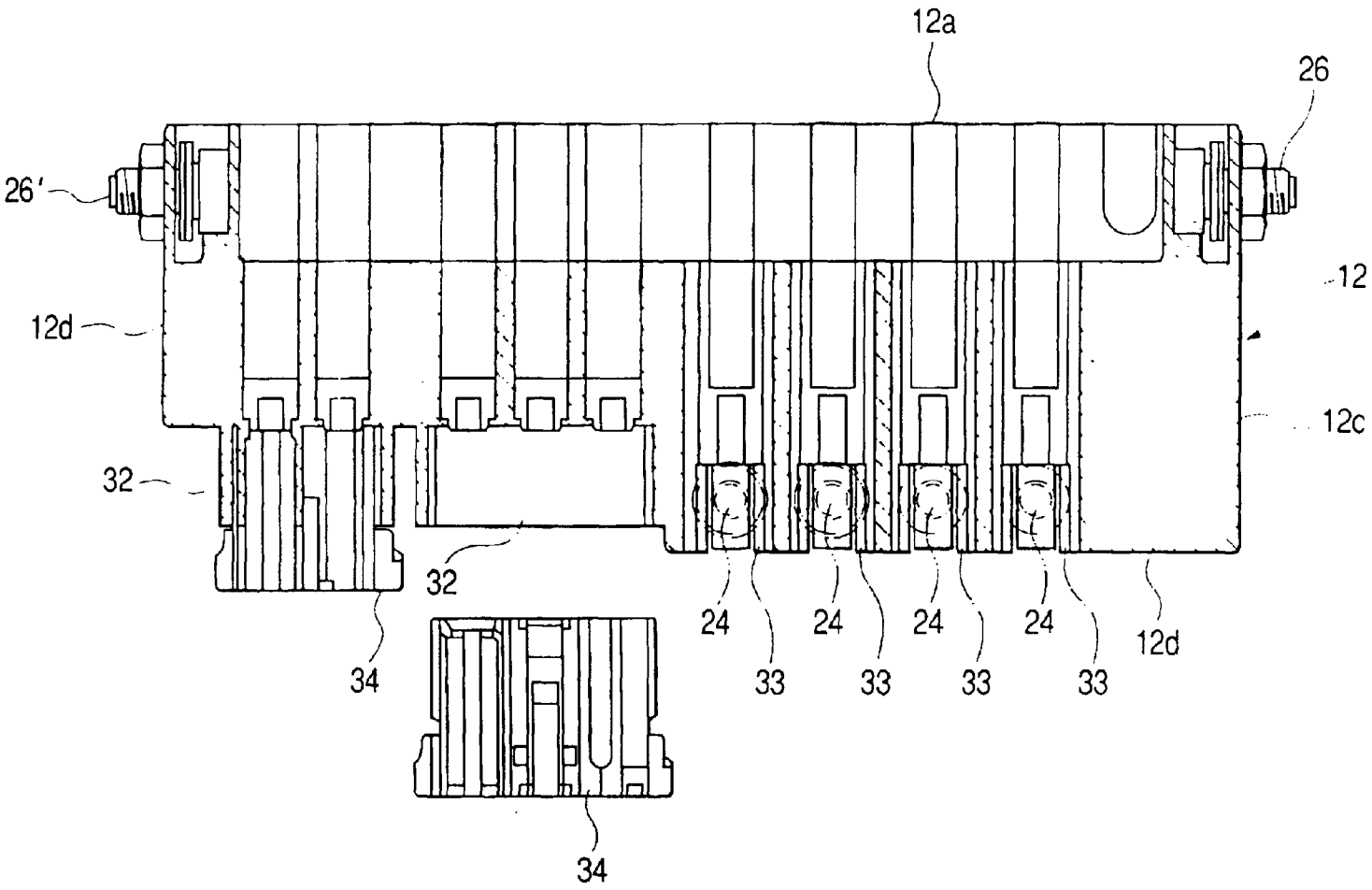
FIG. 13 is a cross-sectional front view of the fuse link assembly when mounted.
Figure 14:
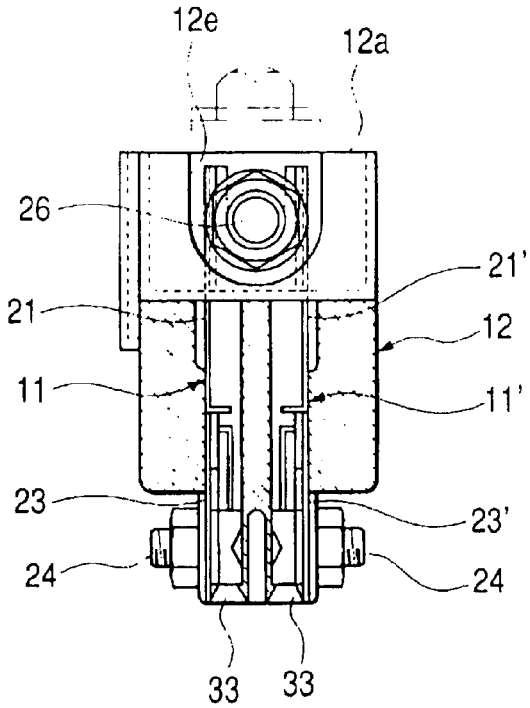
FIG. 14 is a cross-sectional right side view of the fuse link assembly when mounted.
Figure 15:
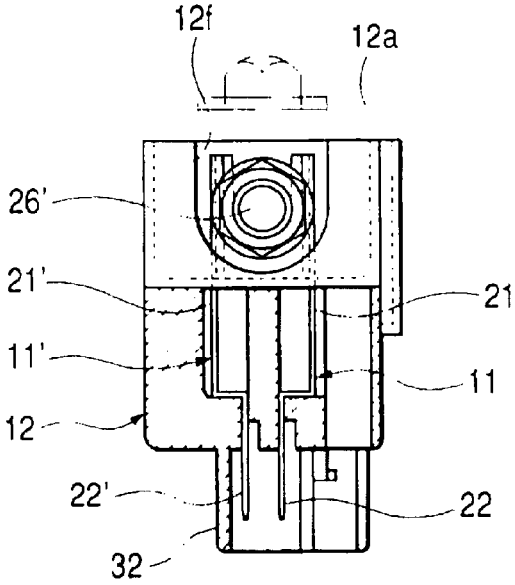
FIG. 15 is a cross-sectional left side view of the fuse link assembly when mounted.
Figure 16:
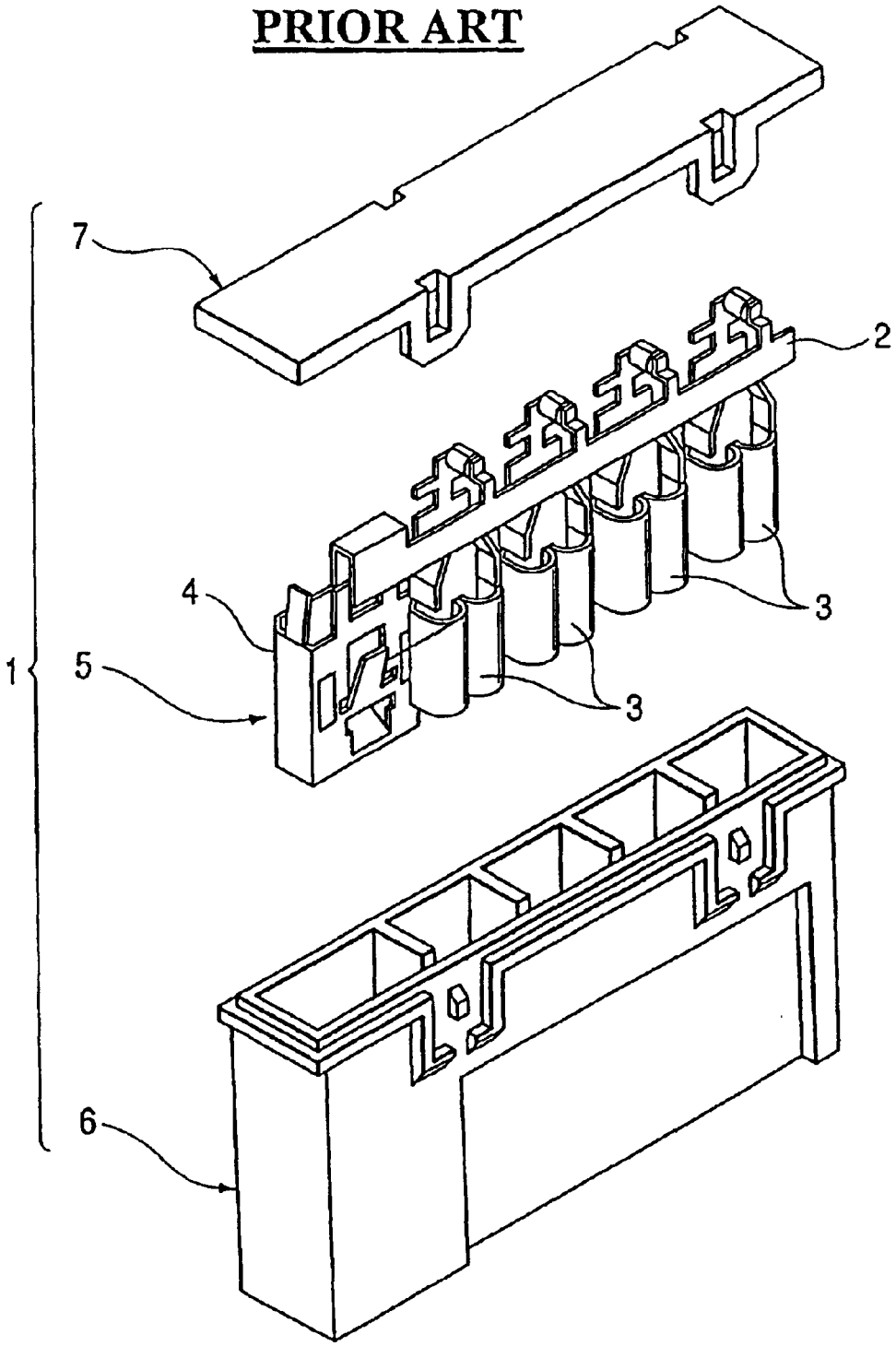
FIG. 16 PRIOR ART
FIG. 16 is an exploded perspective view of a related-art fuse link assembly.

FIGS. 8A through 15 show another embodiment of the invention. Those elements which are the same as the constituent elements described in connection with the embodiment are assigned the same reference numerals, and their repeated explanations are omitted. FIGS. 8A and 8B are explanatory views, wherein FIG. 8A is a front view of a first fuse circuit, and FIG. 8B is a side view of the same. FIGS. 9A and 9B are explanatory views, wherein FIG. 9A is a front view of a second fuse circuit, and FIG. 9B is a side view of the same. FIGS. 10A through 10C are explanatory views, wherein FIG. 10A is a front view of the housing, FIG. 10B is a bottom view of the same, and FIG. 10C is a side view of the same. FIGS. 11A through 11D are explanatory views of the housing in which the first and second fuse circuits are incorporated, wherein FIG. 11A is a plan view of the housing, FIG. 11B is a front view of the same, FIG. 11C is a bottom view of the same, and FIG. 11D is a side view of the same. FIGS. 12A through 12C are explanatory views of the fuse link assembly when mounted, wherein FIG. 12A is a plan view of the fuse link assembly, FIG. 12B is a front view of the same, and FIG. 12C is a bottom view of the same. FIG. 13 is a cross-sectional front view of the fuse link assembly when mounted. FIG. 14 is a cross-sectional right side view of the fuse link assembly when mounted. FIG. 15 is a cross-sectional left side view of the fuse link assembly when mounted.

As shown in FIGS. 8A through 9B, the principal difference between the fuse link assembly 10 according to the embodiment and that described in connection with the first embodiment lies in that a general portion of the joint plate 21 of the first fuse circuit 11 and a general portion of the joint plate 21' of the second fuse circuit 11' are formed into the shape of a plate without involvement of a bending. The right end of the joint plate 21 shown in FIGS. 8A and 8B opposes the left end of the joint plate 21' shown in FIGS. 9A and 9B. A fold portion 21*b* provided at the right end of the joint plate 21 and a fold portion 21*b'* provided at the left end of the joint plate 21' are folded so as to oppose each other (i.e., on the back of paper). Notches 27, 27' which serve as circuit connection portions are formed in the fold portions 21*b*, 21*b'*.

A fold portion 21*d* is formed, by folding the end of the joint plate 21, in the notch 28 formed in the other end of the joint plate 21 of the first fuse circuit 11, in the same manner as the fold portion 21*b*.

Accordingly, in the embodiment, the notches 27, 27' and the notch 28 are formed so as to extend sideways. As shown in FIG. 10C, notches 12*e*, 12*f* are formed in side surfaces 12*c*, 12*d* of the housing 12. As shown in FIGS. 12A, 13, 14, and 15, the joint bolt 26 and the bolt 26' for battery connection are fastened by way of the notches 12*e* and 12*f*.

In the embodiment, fusible portions 25 and 25' to be used for connecting the joint plates 21, 21' and the first and second terminals 20, 20'. As shown in FIGS. 8 and 9, caulking pieces 25*b*, 25*b'* are provided in the shape of a cross, and an unillustrated low-fusing-point metal mount portion is fixed to the caulking pieces 25*b*, 25*b'* by caulking.

Figure 9B:
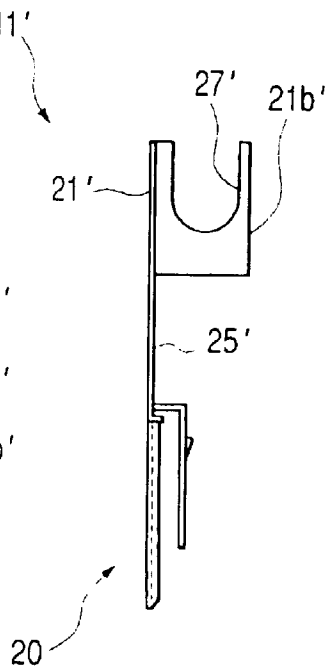
Figure 9A:
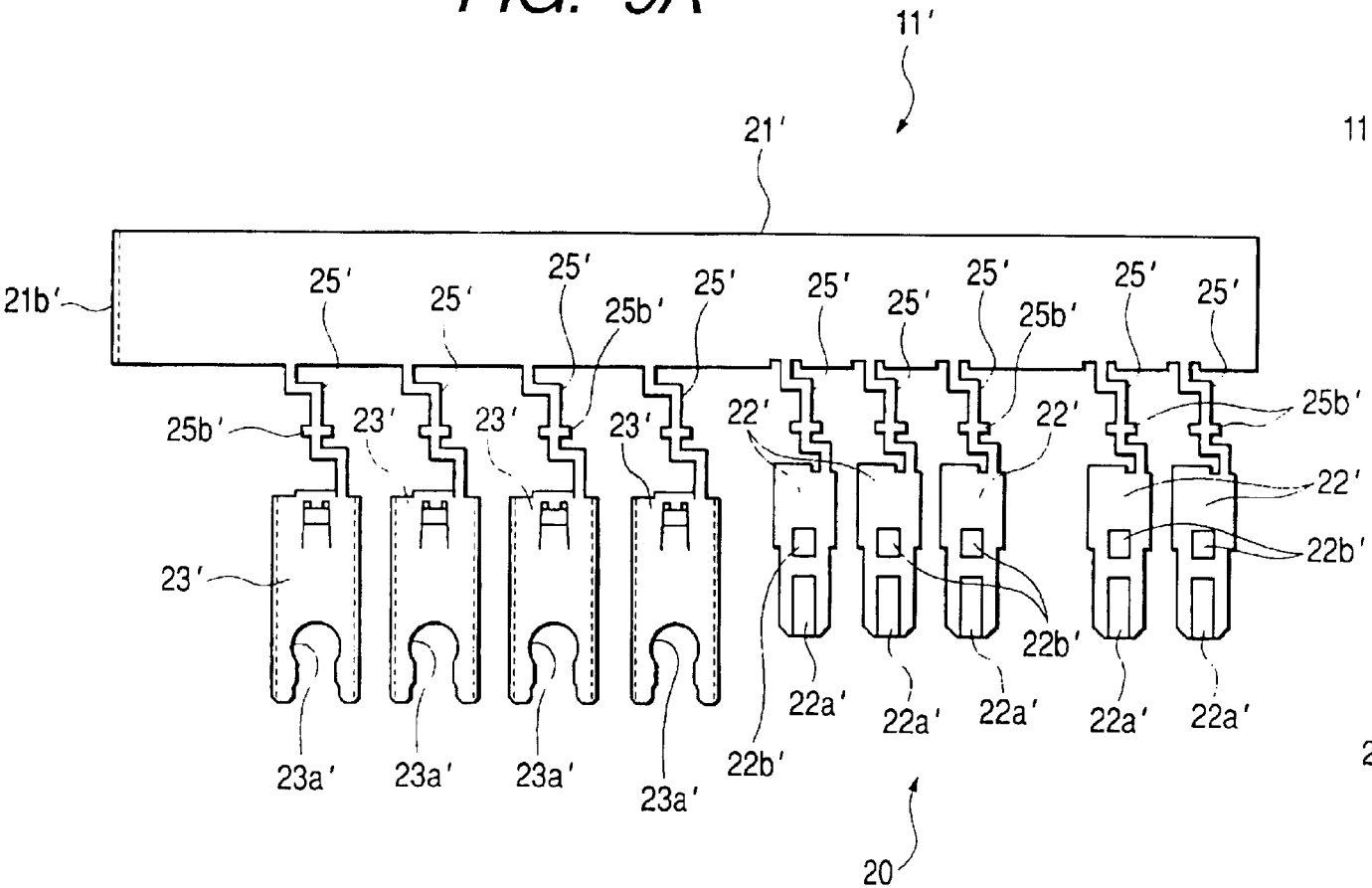
Figure 10A:
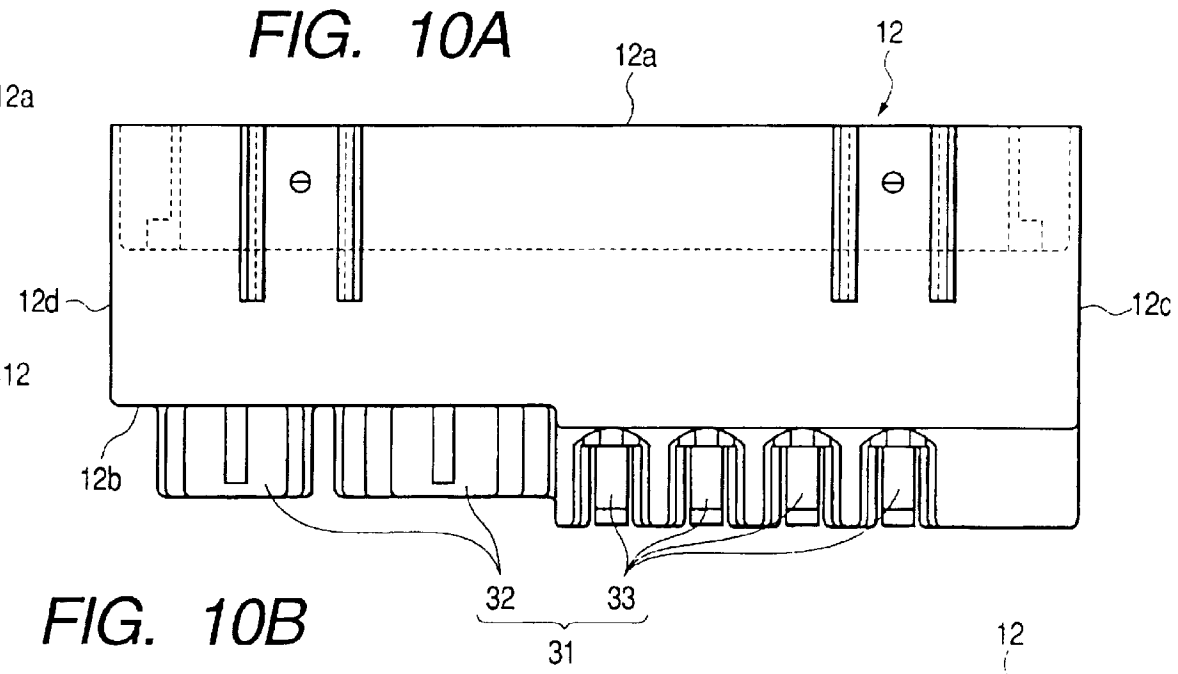
Figure 10B:
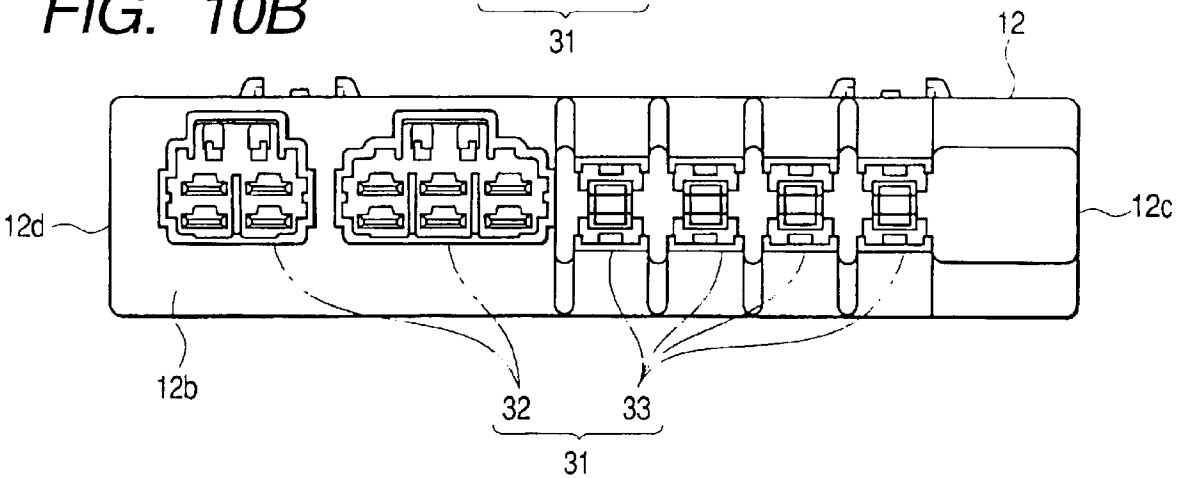
Figure 10C:
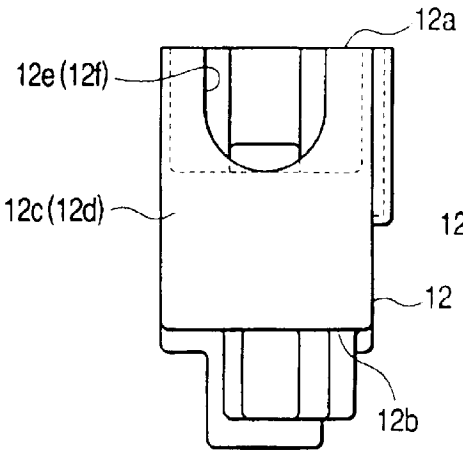
FIG. 10C is a side view of the same.
Figure 11A:
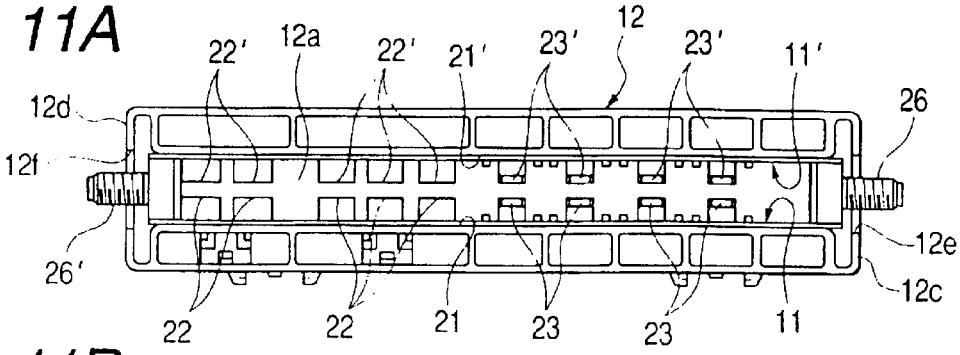
Figure 11B:
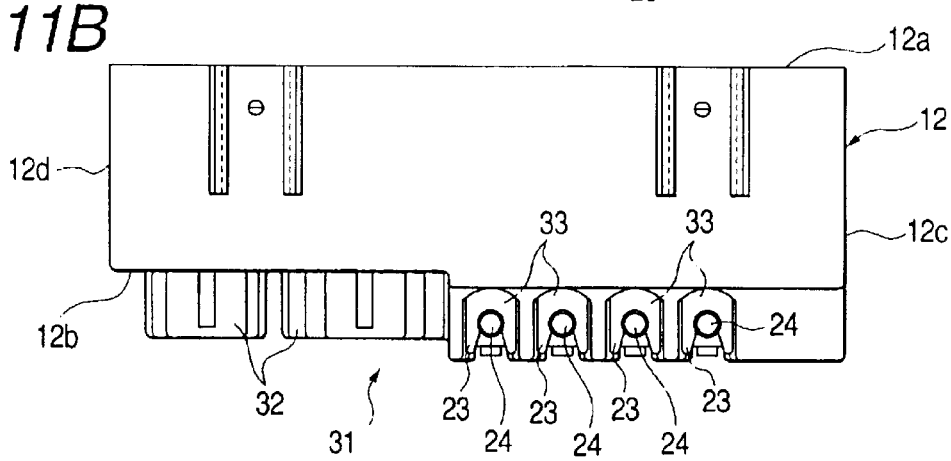
Figure 11C:
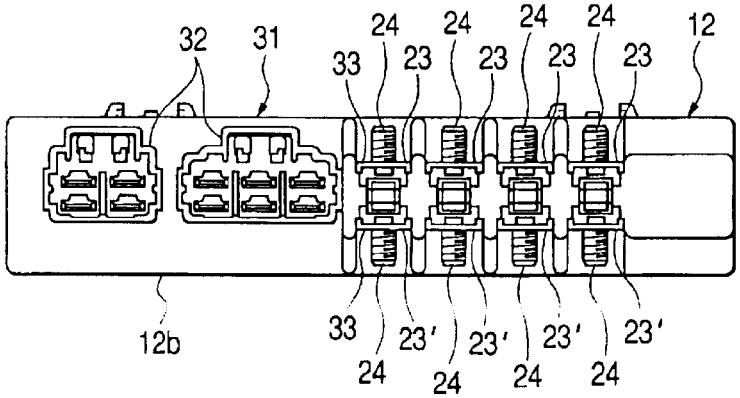
Figure 11D:
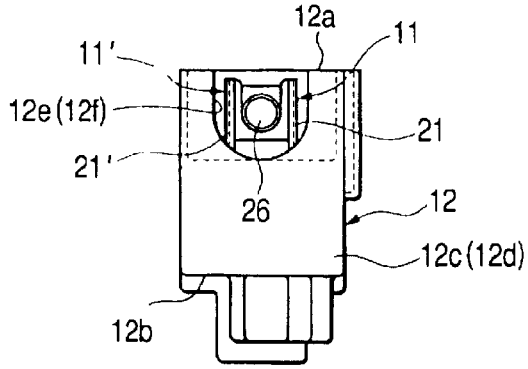
Figure 12A:
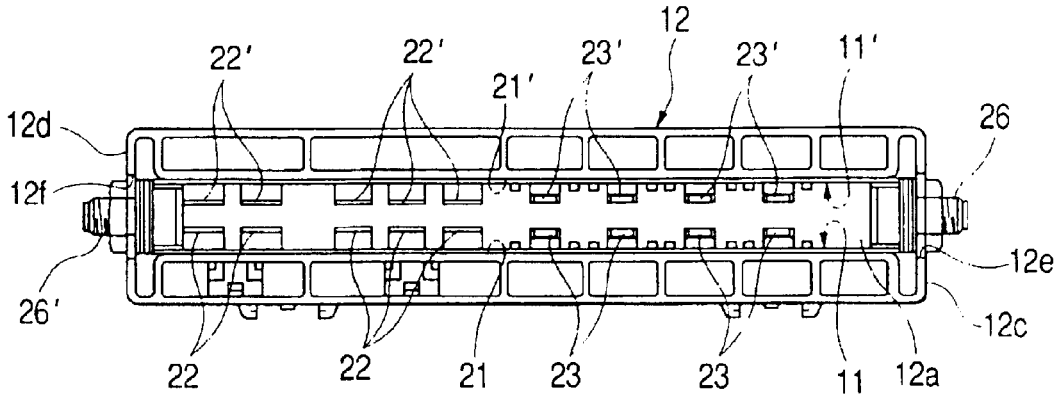
Figure 12B:
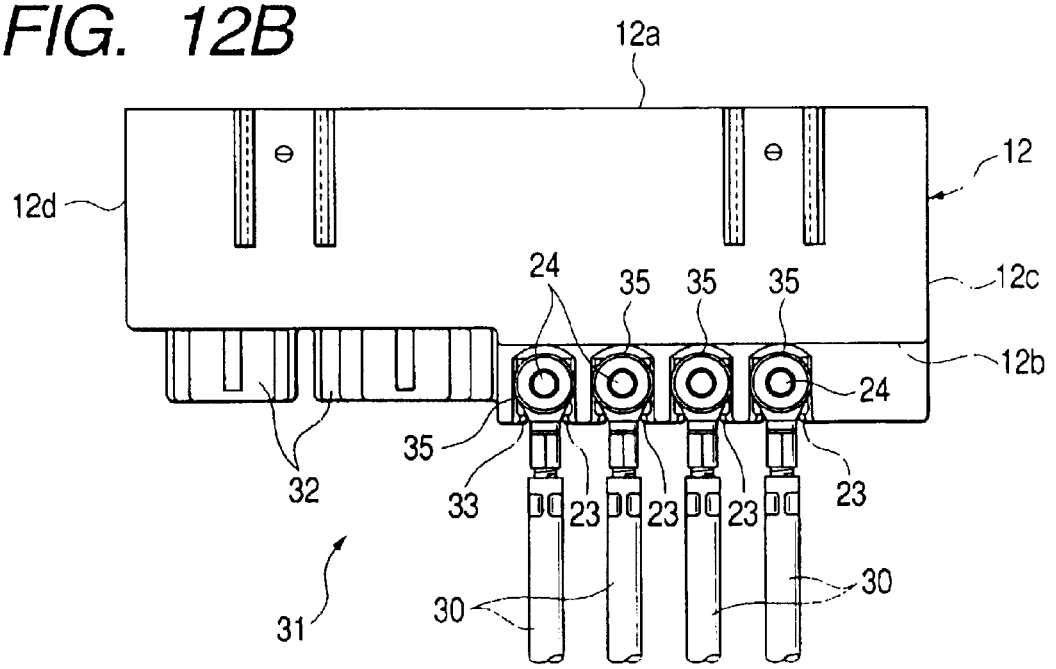
Figure 12C:
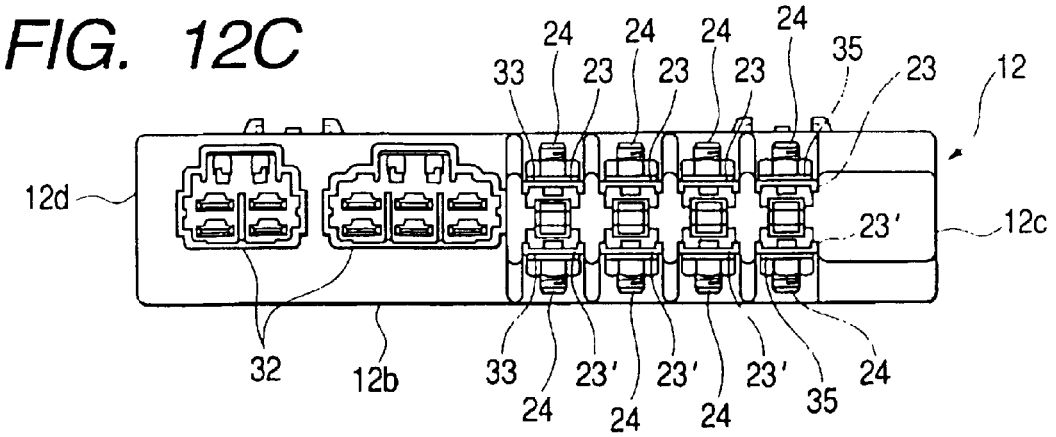
FIG. 12C is a bottom view of the same.

In the fuse link assembly 10 according to the embodiment, the first fuse circuit 11 shown in FIGS. 8A and 8B and the second fuse circuit 11' shown in FIGS. 9A and 9B are arranged so as to oppose each other, and the thus-assembled first and second fuse circuits 11, 11' are inserted into an opening portion 12*a* of the housing 12 shown in FIGS. 10A through 10C. At this time, as shown in FIGS. 11A through 11C, the first and second fuse circuits 11, 11' are incorporated into the housing 12 while the joint bolt 26 is inserted between the notches 27, 27' of the first and second fuse circuits 11, 11' and while the bolt 26' is inserted into the notch 28.

In this way, while the first and second fuse circuits 11, 11' are incorporated into the housing 12, the male terminals 22 and 22' are attached to the connectors 32. The screw terminals 23 and 23' are inserted into the terminal thread portions 33 As shown in FIG. 13, the mating connectors 34 are inserted into the connectors 32 and the stud terminals 35 are fastened to the terminal thread portions 33 via the studs 24.

In the embodiment, four screw terminals 23 and four 23' are provided in the same manner as in the case of the previous embodiment. Five male terminals 22 and five male terminals 22' are provided.

Accordingly, the embodiment yields the same operation and effect as those described in connection with the embodiment. Hence, the joint bolt 26 can be fastened by way of the notch 12*e* formed in the side 12*c* of the housing 12, and the joint bolt 26' can be fastened by way of the notch 12*f* formed in the side surface 12*d* of the housing 12. Hence, operability is improved.

The fuse link assemblies 10 described in connection with the embodiments have described a case where the two fuse circuits 11, 11' are incorporated into one housing 12. The invention is not limited to this case. Three or more fuse circuits can be incorporated into one housing. Even in this case, fuse circuits are juxtaposed.

As has been described, fuse circuit having provided thereon a plurality of terminals in a chain manner is incorporated into a housing in parallel. Hence, the number of circuits can be increased in the widthwise direction in which the fuse circuits are juxtaposed, without involvement of an increase in the longitudinal direction in which terminals are arranged in a chain manner. Accordingly, the number of circuits can be increased by means of an enlargement of the housing in which fuse circuits are to be juxtaposed. The number of circuits can be increased, by means of enlargement of only the width of a fuse link assembly which is easy to change, while enlargement of the longitudinal direction of the housing stemming from packaging of circuits is minimized. Consequently, a larger number of circuits can be packed while the entire fuse link assembly is made compact and space-saving, and a mount space can be utilized effectively.

According to the invention, a plurality of juxtaposed fuse circuits are connected to a power input portion by means of connection of a common circuit connection portion. Hence, the connection of an I/O portion can be set efficiently.

The plurality of terminals are cut depending on the presence or absence of a circuit to be connected to the terminals. Hence, the number of terminals to be provided in a chain manner can be changed arbitrarily in accordance with the number of circuit to which the fuse link assembly is to be connected. Hence, only one type of fuse link assembly can be used for different objects.

A housing having a plurality of fuse circuits incorporated therein is connected directly to a relay box main body. There can be omitted a block body, which would otherwise be interposed between a housing having a plurality of fuse circuits incorporated therein and a relay box main body in normal times. Accordingly, an operation for mounting a fuse link assembly is simplified, and there can be achieved cost cutting in association with omission of a block body.

A plurality of fuse circuits, each having a plurality of terminals connected to a common joint plate in a chain manner, are provided with circuit connection portions sharing a power input portion; the circuit connection portions are fastened together; and the plurality of fuse circuits are incorporated into the housing in parallel. Fastening of a plurality of fuse circuits and incorporation of the fuse circuits into a housing can be made possible, thereby simplifying ease of assembly. At this time, a plurality of fuse circuits are incorporated into a housing in parallel, and hence the number of circuits can be increased in the widthwise direction in which the fuse circuits are juxtaposed, without involvement of an increase in the longitudinal direction in which terminals are arranged in a chain manner. A mount space can be utilized effectively.

What is claimed is:

1. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portions, wherein the at least two fuse circuits are separated by a gap measured in a direction generally orthogonal to the direction of extension.

2. The fuse link assembly according to claim 1, wherein each of the plurality of terminals are configured to be easily removable in accordance with a presence of circuits to be connected to the terminals.

3. The fuse link assembly according to claim 1, wherein the housing on which the fuse circuits are mounted is configured so as to be directly connectable to a relay box main body.

4. A layout method for a fuse link assembly comprising the steps of:

providing at least two fuse circuits, each having a plurality of terminals and a common joint plate, the terminals being be arranged longitudinally in a chain manner and connected to the joint plate with fusible portions;

providing with a circuit connection portion sharing a power input portion;

fastening the circuit connection portion together; and mounting the fuse circuits in the housing to extend generally in parallel with each other, wherein, when the fuse circuits are mounted in the housing, they are separated by a gap measured in a direction generally orthogonal to the direction of extension.

5. The fuse link assembly according to claim 1, wherein the plurality of terminals on one of said at least two fuse circuits comprises at least a first terminal and a second terminal, wherein said first and second terminals are of different structural configurations.

6. The fuse link assembly according to claim 5, wherein said first terminal comprises a male terminal.

7. The fuse link assembly according to claim 5, wherein said second terminal comprises a screw terminal.

8. The fuse link assembly according to claim 1, wherein said plurality of terminals on one of said at least two fuse circuits are arranged substantially in the same plane, which extends substantially in parallel to the direction of extension of said fuse circuits.

9. The fuse link assembly according to claim 1, wherein said plurality of terminals on one of said at least two fuse circuits are generally arranged in two separate planes, arranged substantially parallel to each other and to the direction of extension of said fuse circuits.

10. The fuse link assembly according to claim 1, wherein said at least two fuse circuits are connected through a fusible element.

11. The fuse link assembly according to claim 1, wherein said at least two fuse circuits are connected through an ALT circuit.

12. The fuse link assembly according to claim 1, wherein said at least two fuse circuits are connected through a fusible element and an ALT circuit.

13. The fuse link assembly according to claim 1, wherein said at least two fuse circuits are electrically connected in series with respect to said power input portion.

14. The fuse link assembly according to claim 1, wherein said circuit connection portions of said at least two fuse circuits extend toward each other, generally orthogonally from the direction of extension of said fuse circuits.

15. The fuse link assembly according to claim 1, further comprising fastening means for simultaneously connecting said at least two fuse circuits to each other, at said circuit connection portions, and to said housing.

16. The fuse link assembly according to claim 1, wherein:

said at least two fuse circuits comprises a first fuse circuit and a second fuse circuit;

said first fuse circuit further comprises a proximal end connected to said power input portion, and a distal end connected to said second fuse circuit via said circuit connection portion; and said second fuse circuit further comprises a proximal end connected to said first fuse circuit via said circuit connection portions, and a distal end arranged generally near said proximal end of said first fuse circuit.

17. The fuse link assembly according to claim 16, wherein said first and second fuse circuits, along with said circuit connection portions of said first and second fuse circuits, forms a generally U-shaped connection.

18. A fuse link assembly comprising:

a first fuse circuit;

a second fuse circuit; and a housing; wherein:

said first and second fuse circuits each comprise a common joint plate, a plurality of terminals successively extending from said common joint plate along a direction of extension of said common joint plate, and a circuit connection portion arranged at one end of said common joint plate;

said plurality of terminals are connected to said first and second fuse circuits via fusible elements;

said first and second fuse circuits are offset from each other so as to generally extend in parallel directions, said parallel directions being in two separate planes.

19. The fuse link assembly according to claim 18, wherein:

said first fuse circuit further comprises a proximal end connected to a power input portion, and a distal end connected to said second fuse circuit via said circuit connection portion; and said second fuse circuit further comprises a proximal end connected to said first fuse circuit via said circuit connection portions, and a distal end arranged generally near said proximal end of said first fuse circuit.

20. The fuse link assembly according to claim 19, wherein said first and second fuse circuits, along with said circuit connection portions of said first and second fuse circuits, forms a generally U-shaped connection.

21. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portion, wherein the plurality of terminals on one of said at least two fuse circuits comprises at least a first terminal and a second terminal, wherein said first and second terminals are of different structural configurations.

22. The fuse link assembly according to claim 21, wherein said first terminal comprises a male terminal.

23. The fuse link assembly according to claim 21, wherein said second terminal comprises a screw terminal.

24. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portion, wherein said plurality of terminals on one of said at least two fuse circuits are generally arranged in two separate planes, arranged substantially parallel to each other and to the direction of extension of said fuse circuits.

25. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portion, wherein said at least two fuse circuits are connected through a fusible element.

26. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portion, wherein said at least two fuse circuits are connected through a fusible element and an ALT circuit.

27. A fuse link assembly comprising:

at least two fuse circuits, each having a plurality of terminals, a common joint plate and a circuit connection portion, the terminals being arranged longitudinally in a chain manner and connected to the joint plate with fusible portions; and a housing in which the fuse circuits are mounted; wherein the at least two fuse circuits are mounted in the housing so as to extend generally in parallel with each other; and the at least two fuse circuits share a power input portion, wherein:

said at least two fuse circuits comprises a first fuse circuit and a second fuse circuit;

said first fuse circuit further comprises a proximal end connected to said power input portion, and a distal end connected to said second fuse circuit via said circuit connection portion; and said second fuse circuit further comprises a proximal end connected to said first fuse circuit via said circuit connection portions, and a distal end arranged generally near said proximal end of said first fuse circuit.

28. The fuse link assembly according to claim 27, wherein said first and second fuse circuits, along with said circuit connection portions of said first and second fuse circuits, forms a generally U-shaped connection.

* * * * *